US005916318A

United States Patent [19]

Anderson

[11] Patent Number: 5,916,318

[45] Date of Patent: Jun. 29, 1999

[54] MACHINE FOR SIMULTANEOUSLY FORMING THREADS OR FINS ON MULTIPLE CYLINDRICAL WORKPIECES

[76] Inventor: Ray C. Anderson, 7605 S. Quebec, Tulsa, Okla. 74136

[21] Appl. No.: 09/064,299

[22] Filed: Apr. 22, 1998

Related U.S. Application Data

[60] Provisional application No. 60/045,413, May 2, 1997.

[51] Int. Cl.[6] ..... B21B 19/12

[52] U.S. Cl. ..... 72/98; 72/110; 72/96

[58] Field of Search ..... 72/96, 97, 98, 72/100, 107, 110

[56] References Cited

U.S. PATENT DOCUMENTS

| | | | |
|---|---|---|---|
| 2,336,133 | 12/1943 | Szabo, Jr. | 72/100 |
| 4,915,166 | 4/1990 | Cunningham et al. | 165/184 |
| 4,942,752 | 7/1990 | Helfman | 72/70 |
| 5,003,690 | 4/1991 | Anderson | 29/727 |
| 5,365,763 | 11/1994 | Cretin et al. | 72/98 |
| 5,644,938 | 7/1997 | Moeltner et al. | 72/96 |
| 5,803,164 | 9/1998 | Schuez et al. | 165/184 |

FOREIGN PATENT DOCUMENTS

| | | | |
|---|---|---|---|
| 495107 | 12/1975 | U.S.S.R. | 72/100 |
| 774685 | 10/1980 | U.S.S.R. | 72/110 |

*Primary Examiner*—Joseph J. Hail, III
*Assistant Examiner*—Susan Kingsbury
*Attorney, Agent, or Firm*—Head, Johnson & Kachigian

[57] ABSTRACT

A machine for simultaneously forming helical threads or fins on the exterior of first, second and third elongated cylindrical workpieces, the machine having first, second and third arbor blocks arranged in a common plane and spaced about a center point in the plane, having first, second and third thread or fin forming discs rotatably affixed respectfully to the first, second and third arbor blocks, and having first, second and third guides longitudinally displaceably and rotationally receiving respectively the first, second and third workpieces so that the first workpiece is guided by the first guide between the first and second discs, the second workpiece is guided by the second guide between the second and third discs and the third workpiece is guided by the third guide between the first and third discs, rotary energy being coupled to at least one of the discs. In an alternate embodiment four elongated cylindrical members are provided with threads or fins.

17 Claims, 5 Drawing Sheets

MACHINE FOR SIMULTANEOUSLY FORMING THREADS OR FINS ON MULTIPLE CYLINDRICAL WORKPIECES

REFERENCE TO PENDING APPLICATIONS

This application claims the benefit of and incorporates by reference prior filed Provisional Application No. 60/045,413 filed May 2, 1997 entitled "Multiple Tube Finning Or Thread Rolling".

REFERENCE TO MICROFICHE APPENDIX

This application is not referenced in any microfiche appendix.

BACKGROUND OF THE INVENTION

I. Field of the Invention

This invention relates generally to a machine and method for simultaneously forming threads or fins on multiple elongated cylindrical workpieces.

II. Description of the Prior Art

There are two basic ways of forming integral spiraled threads or fins on a cylindrical workpiece. The first way is to rotate the workpiece and by the use of a cutting tool, cutting away material from the workpiece external surface to leave helical threads or fins formed of the remaining surface material of the workpiece. This system has the basic disadvantage that it is wasteful of material because of the quantity of material that is cut from the workpiece external surface to form the threads or fins. The second basic method and one more preferred particularly for large scale production, is to form threads by rotating thread forming discs against the surface of rotating workpieces in which the workpiece external surface is caused to flow by plastic deformation to form upstanding spiraled threads or fins and in which no material is removed from the workpieces.

Machines for accomplishing the methods of both of these techniques are well known in the industry and are commonly commercially available.

An example of a machine for forming fins or threads on an elongated cylindrical workpiece is illustrated in U.S. Pat. No. 5,003,690, Ray C. Anderson, inventor, issued Apr. 2, 1991. This patent, which is incorporated herein by reference, illustrates and describes a finning and thread rolling machine capable of producing an integral fin tube, an extruded fin tube, a wrap on fin tube or a thread on an elongated cylindrical member. The machine described in this patent forms a spiraled fin or spiraled threads on a single elongated cylindrical workpiece employing a plurality (three illustrated in the patent) of rotating discs that are supported by arbors capable of being adjustably positioned inwardly and outwardly radially from the workpiece. Rotary motion is supplied to the discs to cause the workpiece to also rotate as fins or threads are formed by metal displacement on the exterior of the workpieces.

The system of U.S. Pat. No. 5,003,690 functions very successfully to accomplish its intended result. This patent and the other United States patents cited in this patent is a source of background material relating to the present invention.

The present invention departs from the concept revealed in U.S. Pat. No. 5,003,690 in a basic and dramatic way in that the present invention provides a machine for simultaneously forming threads or fins on a plurality of elongated cylindrical members.

BRIEF SUMMARY OF THE INVENTION

A machine is provided for simultaneously forming helical threads or fins on the exterior of a plurality of elongated cylindrical rotatable workpieces. The term "workpieces" means an elongated solid cylindrical device on which threads are formed or an elongated tubular cylindrical device on which threads or fins are formed. Typically fins are formed on a tubular member to provide improved heat transfer between fluids or gases exterior of the tubular member with fluids or gases interior of the tubular members.

The machine of this invention is intended to simultaneously manufacture a "plurality" of threaded or finned tubular members. In the preferred practice of the invention, the machine most advantageously simultaneously manufactures threaded or finned tubular members three at a time or four at a time.

The machine for manufacturing simultaneously three threaded or finned workpieces includes first, second and third arbor blocks arranged in a common plane and spaced 120° apart around a center point in the plane. First, second and third thread or fin forming discs are rotatably affixed respectfully to the first, second and third arbor blocks.

First, second and third guides each rotatably receive a workpiece. A first guide is arranged so that a first workpiece is guided between first and second discs. A second workpiece is guided by a second guide between second and third discs. A third workpiece is guided by a third guide between first and the third discs.

Rotary energy is applied by a coupler to at least one of the thread forming discs but in a preferred arrangement to each of the three thread forming discs.

In another embodiment of the invention four elongated cylindrical members are simultaneously provided with threads or fins employing first, second, third and fourth arbor blocks arranged in a common plane and spaced 90° apart. First, second, third and fourth thread forming discs are rotatably affixed respectfully to the first, second, third and fourth arbor blocks. First, second, third and fourth guides longitudinally and slidably receive first, second, third and fourth workpieces in a way to allow the workpieces to rotate. The machine is arranged so that a first workpiece is guided by the first guide between the first and second discs; a second workpiece is guided by the second guide between the second and the third discs; the third workpiece is guided by the third guide between the third and a fourth discs; and the fourth workpiece is guided by the fourth guide between the first and the fourth discs.

When the machine of this invention is used to form spiral fins on tubular workpieces in most instances it is necessary or at least highly desirable to include a mandrel positioned within the workpiece. The mandrel is located within the workpiece where it is contacted by the thread forming discs so as to maintain a preselected internal diameter of the workpiece.

A better understanding of the invention will be obtained from the following description of the preferred embodiments and the claims, taken in conjunction with the attached drawings.

DETAILED DESCRIPTION OF THE PREFERRED EMBODIMENTS

Figure 1:
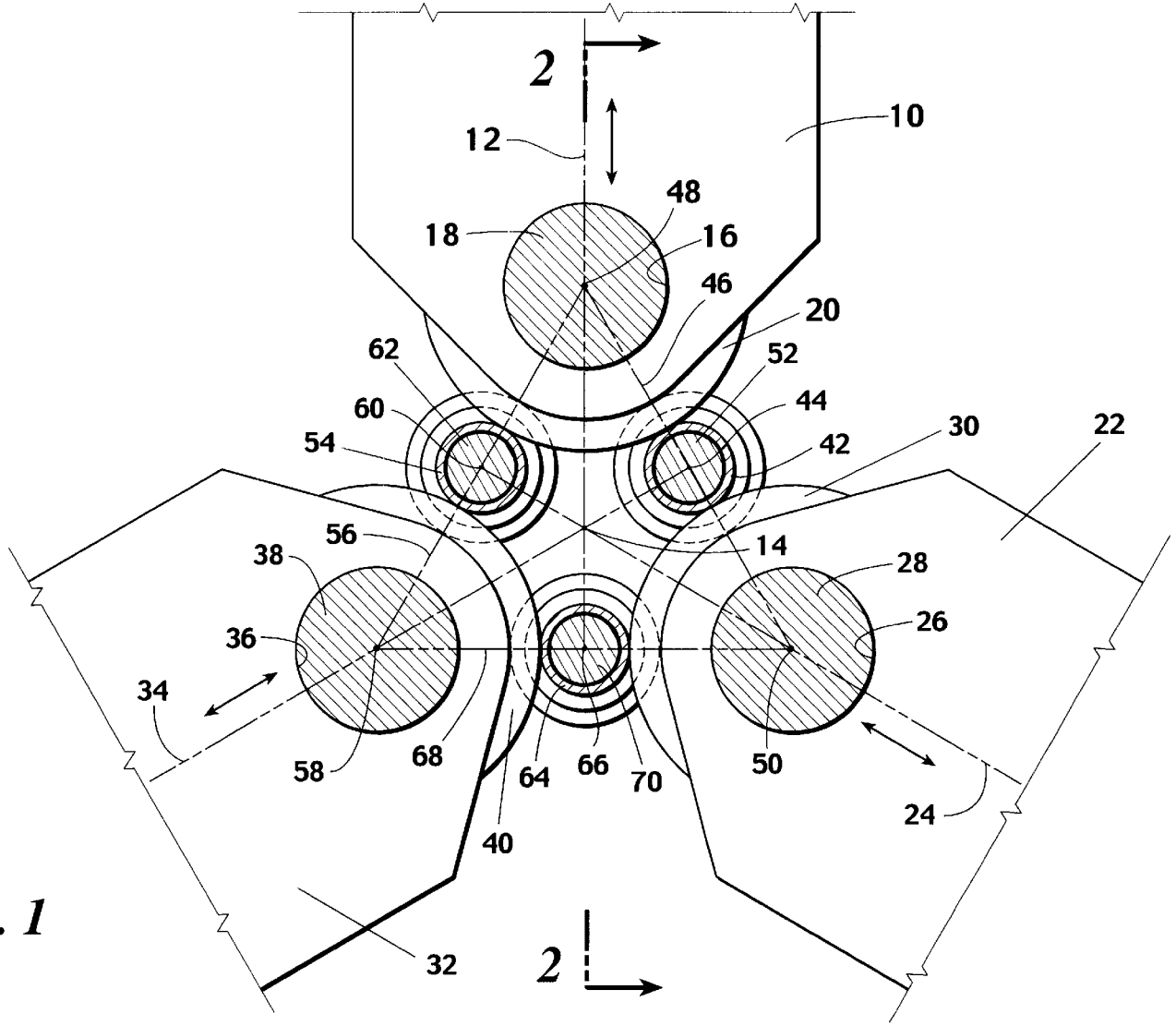
FIG. 1 is an elevational fragmentary cross-sectional view of a machine according to this invention for simultaneously manufacturing fins on three tubular workpieces.

FIG. 1 is an elevational fragmentary cross-sectional view of a machine for forming fins simultaneously on three elongated tubular workpieces. FIG. 1 is a fragmentary view in that it shows only the critical basic elements of the invention and not the entire machine. Specifically, FIG. 1 does not show the superstructure of the machine by which the working components are held with respect to each other. A typical thread or fin forming machine is illustrated in U.S. Pat. No. 5,003,690 which is incorporated herein by reference. The machine includes a first arbor block 10 that is inwardly and outwardly adjustable along a longitudinal axis 12 towards and away from a center point 14. First arbor block 10 has a bearing opening 16 that rotatably receives a shaft 18 to which is affixed a thread forming disc 20.

In like manner, a second arbor block 22 has a longitudinal axis 24 that intersects center point 14 and has a bearing opening 26 that rotatably receives shaft 28 which, in turn, supports a disc 30. A third arbor block 32 has a longitudinal axis 34 that intercepts center point 14 and a bearing opening 36 that rotatably receives a shaft 38 which rotatably supports a disc 40.

Positioned between first disc 20 and second disc 30 is a first elongated tube 42. First tube 42 has a longitudinal axis of rotation 44. An imaginary line 46 extends between the rotational axis 48 of shaft 18 and rotational axis 50 of shaft 28, the imaginary line 46 passing through the tubular workpiece axis of rotation 44. Received within first tube 42 is a solid mandrel 52 that preserves the interior circumferential integrity of the tube as it is externally compressed by discs 20 and 30.

In like manner, a second tube 54 is rotatably supported between disc 20 and 40, an imaginary line 56 passing between the axis of rotation 58 of shaft 38 and the axis of rotation 48 of shaft 18, the line passing through the axis of rotation 60 of tube 54. A mandrel 62 is rotatably positioned within tube 54.

A third tube 64 is rotatably positioned between disc 30 and disc 40 and has an axis of rotation 66 that is on an imaginary line 68 that extends between axis of rotation 58 of shaft 38 and axis of rotation 50 of shaft 28. A mandrel 70 is positioned within tube 64.

Figure 2:
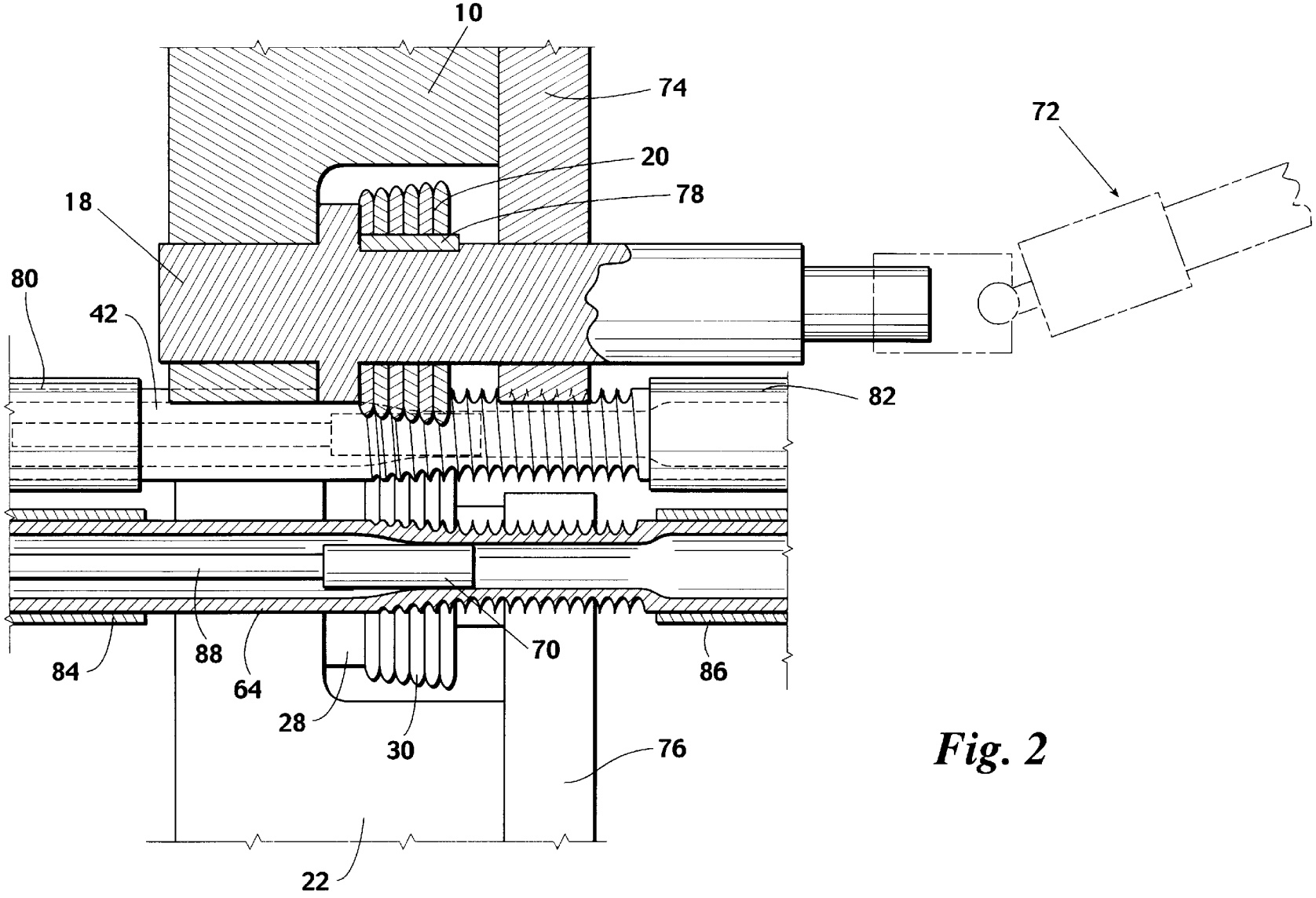
FIG. 2 is a cross-sectional view taken along the line 2—2 of FIG. 1.

FIG. 2 shows more details of the machine for simultaneously forming helical fins on tubes 42, 54 and 64. (Tube 54 is not seen in FIG. 2.) A rotary energy coupler generally indicated by the numeral 72 provides rotational force to shaft 18 to thereby turn disc 20 which engages and thereby rotates first tube 42 as the disc forms on the exterior surface of tube 42. Theoretically only one rotary energy coupler 72 is required as illustrated since the rotation of one disc will result in the rotation of all of the three tubes and each of the other discs, however, in the preferred embodiment, rotary energy is simultaneously supplied to each of shafts 18, 28 and 38 employing a mechanism such as illustrated and described in detail in United States U.S. Pat. No. 5,003,690.

Each of the arbor blocks, 10, 22 and 32 is provided with a removable plate. Removable plate 74 is attached to first arbor block 10 and removable plate 76 is attached to arbor block 22, as seen in FIG. 2, to support the shafts that carry the thread forming discs. The plates are removable to allow replacement of the discs that are keyed to the shafts, the key 78 by which fin forming disc 20 is attached to shaft 18 is seen in FIG. 2.

Tubes 42, 54 and 64 must be guided as they pass through the thread forming portion of the machine. FIG. 2 shows tubular guides 80 and 82 through which tube 42 is guided as it passes between thread forming discs 20 and 30. FIG. 2 also shows guides 84 and 86 that slidably receive tube 64 as it passes between thread forming discs 30 and 40, only disc 30 being seen in FIG. 2.

Mandrel 70 is preferably rotatable about a shaft 88 by which it is supported within tube 64. Mandrel 70 remains fixed in longitudinal location as tube 64 moves past it as fins are formed on the tube exterior surface. In a different arrangement, the mandrel 70 and shaft 88 may be made integral and shaft 88 rotatably supported.

In FIGS. 1 and 2 the tubes 42, 54 and 64 are of the same internal and external diameters. The tubes can be of the same external diameter and of different internal diameters and every other feature of FIGS. 1 and 2 would remain the same except the external diameter of the mandrels. In all instances it is important that the axis of rotation of each tube be on the imaginary line connecting the axii of rotation of the shafts which support the adjacent fin forming discs.

Figure 3:
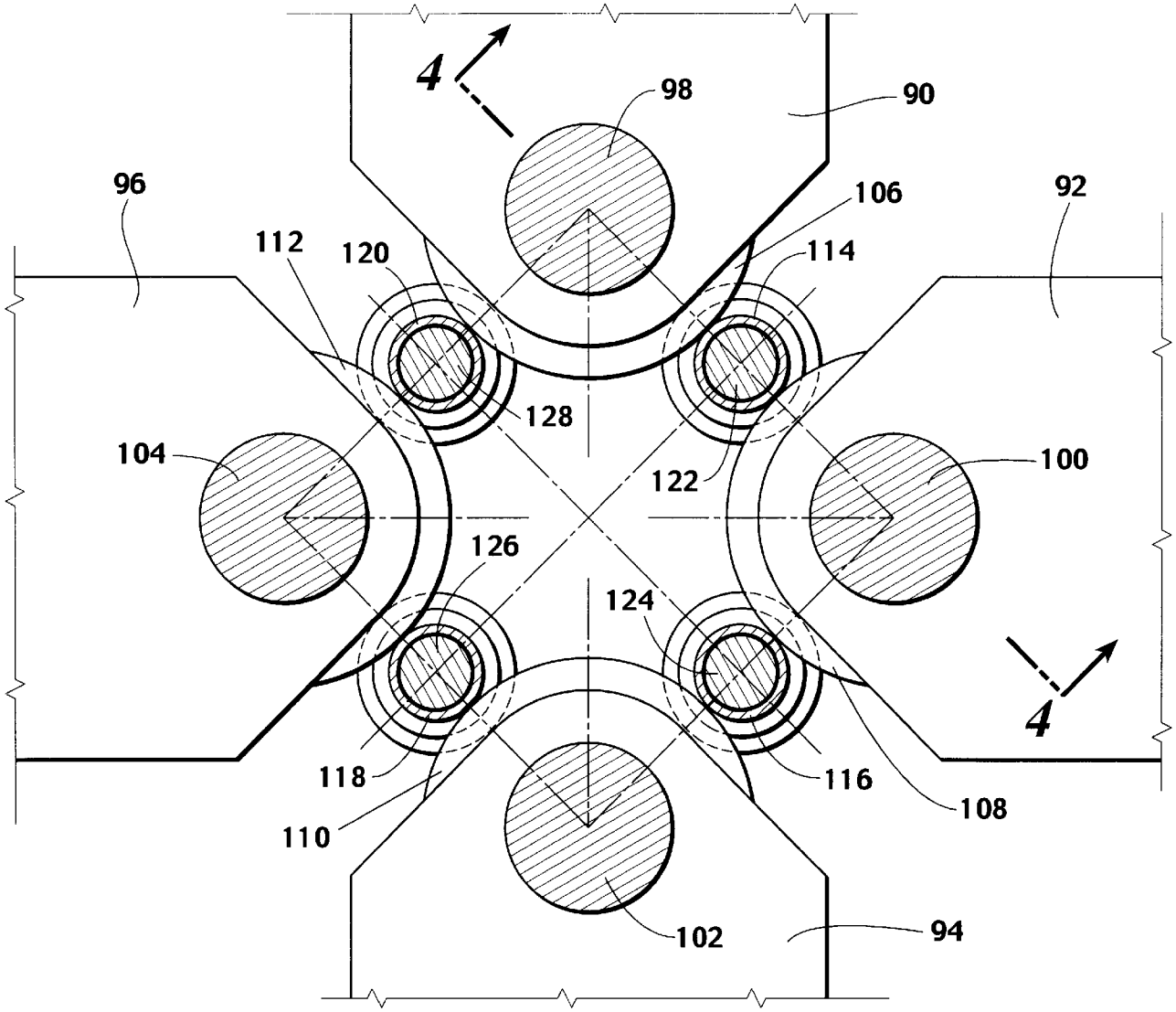
FIG. 3 is an elevational fragmentary cross-sectional view of a machine for simultaneously manufacturing fins on four tubular members simultaneously.
Figure 4:
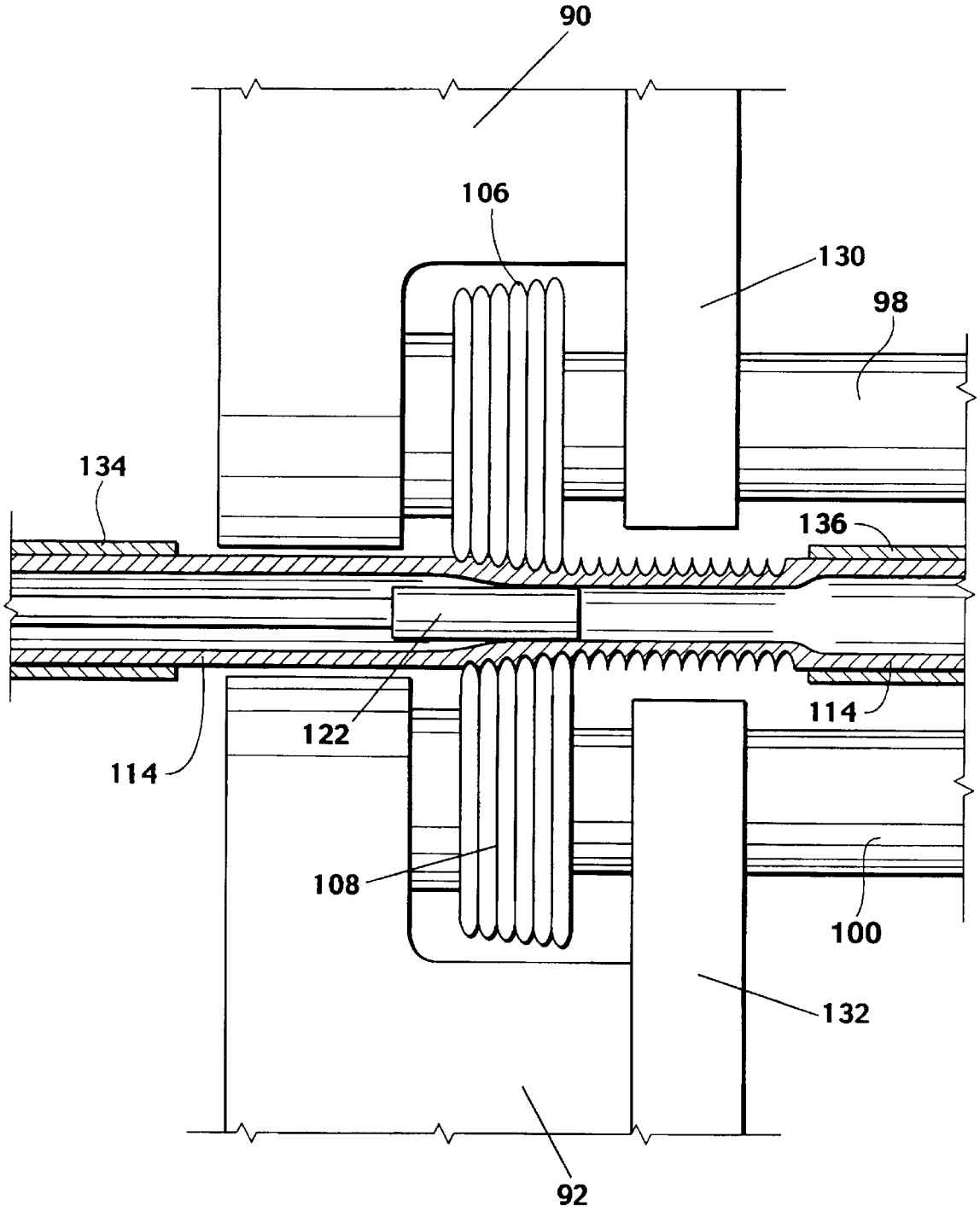
FIG. 4 is a cross-sectional view taken along the line 4—4 of FIG. 3 showing the formation of an integral spiral fin on the exterior of a tubular member.

FIGS. 3 and 4 show an alternate embodiment of the invention wherein fins are simultaneously applied to the exteriors of four elongated tubes. FIGS. 3 and 4 show four arbor blocks 90, 92, 94 and 96 each supporting a shaft 98, 100, 102, and 104 respectively. The shafts supporting rotating thread forming discs 106, 108, 110 and 112 respectively. The discs engage elongated tubular members 114, 116, 118 and 120, each tube being contacted by adjacent and opposed thread forming disc as was previously described with reference to FIGS. 1 and 2. Each of the tubes is positioned centrally between the rotational axii of adjacent thread forming discs and each of the tubes, as seen in FIG. 3, includes a mandrel, the mandrels being indicated by the numerals 122, 124, 126 and 128.

FIG. 4 shows in cross-section the relationship between arbor blocks 90 and 92 that rotatably support shafts 98 and 100 that, in turn, rotatably supports thread forming discs 106 and 108. Each of the arbor blocks has an associated removable support block, support blocks 130 and 132 being seen in FIG. 4.

Guides are provided for each of the elongated cylindrical members, guides 134 and 136 that support tube 114 are seen in FIG. 4.

Rotational energy is coupled to at least one of the shafts in the embodiment of FIGS. 3 and 4 and preferably to all of the shafts in each system. A system to couple rotational energy to the multiplicity of shafts that employed in practicing the invention is illustrated and described in U.S. Pat. No. 5,003,690.

Figure 5:
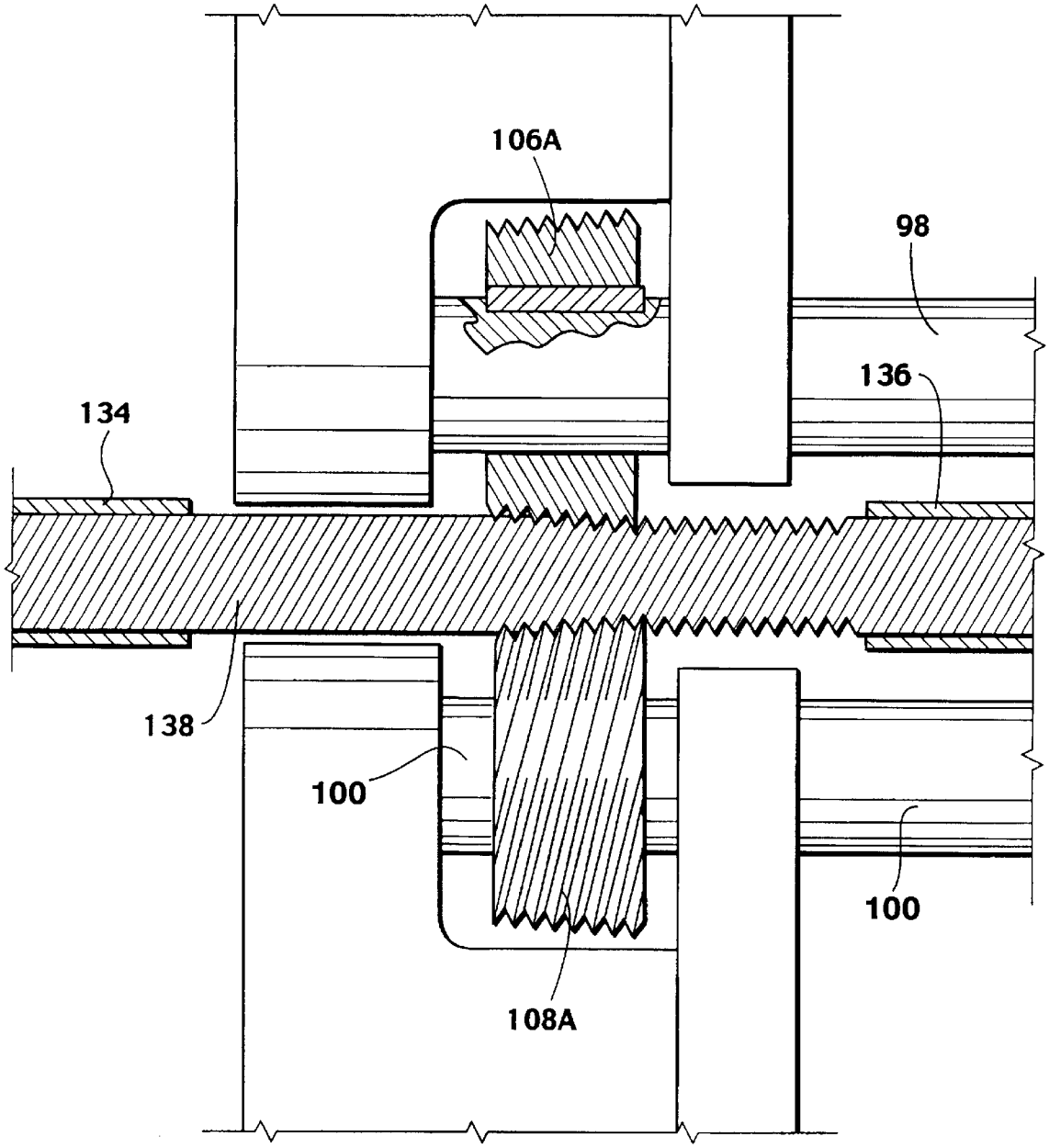
FIG. 5 is an elevational cross-sectional view of a portion of a machine for simultaneously forming threads on an elongated cylindrical member similar to the cross-sectional view shown in FIG. 4 but wherein the cylindrical workpiece is solid rather than a tube and threads rather than fins are formed on the exterior of the workpiece.

FIGS. 1 through 4 illustrate a machine for simultaneously manufacturing three or four finned tubular members. FIG. 5 is a cross-sectional view as in FIG. 4, the only difference being that thread forming discs 106A and 108A are configured to provide screw type threads, as contrasted with fins, on the exterior of the elongated cylindrical member 138. The only other difference between FIG. 4 and FIG. 5 is that since elongated cylindrical member 138 in FIG. 5 is solid, an internal mandrel is not required.

The thread forming discs as illustrated in FIGS. 1 through 5 are shaped according to the desired shape of the fins or thread to be formed on the elongated cylindrical members. In FIGS. 1 through 4 the formed fins are of relatively short height compared to the diameter of the tubular members however, relatively high integral fins can be formed utilizing the invention described herein when the tubes are of relatively thick sidewall and highly malleable, such as aluminum.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed:

1. A machine for simultaneously forming helical fins or threads on the exterior of first, second and third elongated cylindrical rotatable workpieces, comprising:

first, second and third arbor blocks arranged in a common plane and spaced 120° apart about a center point in the plane;

first, second and third fin or thread forming discs rotatably affixed respectfully to said first, second and third arbor blocks;

first, second and third guides longitudinally displaceably and rotationally receiving respectively the first, second and third workpieces whereby the first workpiece is guided by the first guide between said first and second discs, the second workpiece is guided by the second guide between said second and third discs and the third workpiece is guided by the third guide between said first and third discs; and rotary energy couplers for imparting rotation to at least one of said discs.

2. A machine for simultaneously forming helical fins or threads on the exterior of first, second and third elongated cylindrical workpieces according to claim 1 wherein the workpieces are tubes and the discs are fin forming discs whereby fins are simultaneously formed on three tubes.

3. A machine for simultaneously forming helical fins or threads on the exterior of first, second and third elongated cylindrical workpieces according to claim 2 including:

a mandrel received within each of the tubes in the area thereof engaged by said discs.

4. A machine for simultaneously forming helical fins or threads on the exterior of first, second and third elongated cylindrical workpieces according to claim 1 wherein the workpieces are solid rods and the discs are thread forming discs whereby threads are simultaneously formed on three solid rods.

5. A machine for simultaneously forming helical fins or threads on the exterior of first, second and third elongated cylindrical workpieces according to claim 1 wherein each of said discs has a helical configured fin or thread forming exterior surface, the depth of the fin or thread forming surface progressing from shallower to deeper in a direction of the axis of rotation of the disc.

6. A machine for simultaneously forming helical fins or threads on the exterior of first, second and third elongated cylindrical workpieces according to claim 1 wherein at least two of said arbor blocks are displaceable along an axis that is radial of said center point.

7. A machine for simultaneously forming helical fins or threads on the exterior of first, second and third elongated cylindrical workpieces according to claim 1 wherein the rotatable axii of said discs form an equilateral triangle and wherein the rotational axii of the workpieces form an equilateral triangle.

8. A machine for simultaneously forming helical fins or threads on the exterior of first, second and third elongated cylindrical workpieces according to claim 1 wherein said rotary energy couplers impart rotation simultaneously to each of said first, second and third discs.

9. A machine for simultaneously forming helical fins or threads on the exterior of first, second, third and fourth elongated cylindrical workpieces, comprising:

first, second, third and fourth arbor blocks arranged in a common plane and spaced 90° apart about a center point in the plane;

first, second, third and fourth fin or thread forming discs rotatably affixed respectfully to said first, second, third and fourth arbor blocks;

first, second, third and fourth guides longitudinally displaceably and rotationally receiving respectively the first, second, third and fourth workpieces whereby the first workpiece is guided by the first guide between said first and second discs, the second workpiece is guided by the second guide between said second and third discs, the third workpiece is guided by the third guide between said third and fourth discs and the fourth workpiece is guided by the fourth guide between said first and fourth discs; and rotary energy transfer linkages for imparting rotation to at least one of said discs.

10. A machine for simultaneously forming helical fins or threads on the exterior of first, second, third and fourth elongated cylindrical workpieces according to claim 9 wherein the workpieces are tubes and the discs are fin forming discs whereby fins are simultaneously formed on four tubes.

11. A machine for simultaneously forming helical fins or threads on the exterior of first, second, third and fourth elongated cylindrical workpieces according to claim 10 wherein the workpieces are tubular including:

a mandrel received within each of the tubes in the area thereof engaged by said discs.

12. A machine for simultaneously forming helical fins or threads on the exterior of first, second, third and fourth elongated cylindrical workpieces according to claim 9 wherein the workpieces are solid rods and the discs are thread forming discs whereby threads are simultaneously formed on four solid rods.

13. A machine for simultaneously forming helical fins or threads on the exterior of first, second, third and fourth elongated cylindrical workpieces according to claim 9 wherein each of said discs has a helical configured fin or thread forming exterior surface, the depth of the fin or thread forming surface progressing from shallower to deeper in a direction of the axis of rotation of the disc.

14. A machine for simultaneously forming helical fins or threads on the exterior of first, second, third and fourth elongated cylindrical workpieces according to claim 9 wherein at least two of said arbor blocks are displaceable along an axis that is radial of said center point.

15. A machine for simultaneously forming helical fins or threads on the exterior of first, second, third and fourth elongated cylindrical workpieces according to claim 9 wherein the rotatable axii of said discs form a square and wherein the rotatable axii of the workpieces form a square.

16. A machine for simultaneously forming helical fins or threads on the exterior of first, second, third and fourth elongated cylindrical workpieces according to claim 9 wherein said rotary energy couplers impart rotation simultaneously to each of said first, second, third and fourth discs.

17. A machine for simultaneously forming helical fins or threads on the exterior of a plurality of at least three elongated cylindrical rotatable workpieces, each having a workpiece axis of rotation, comprising:

a plurality of arbor blocks equal in number to the number of cylindrical workpieces and arranged in a common plane and spaced apart about a center point in the plane;

a fin or thread forming disc rotatably affixed to each of said arbor blocks, each disc having an axis of rotation;

a separate guide longitudinally displaceably and rotationally supporting each of said workpieces whereby said workpieces are guided between adjacent discs, the discs serving to form threads or fins on the workpieces; and a rotary energy coupler for imparting rotation to at least one of said discs, the axes of rotation of said workpieces as rotatably supported by said guides and the axes of rotation of said discs being parallel, the axis of rotation of each workpiece being in a plane of the axes of rotation of adjacent discs.

* * * * *